US010415912B2

(12) United States Patent
Iwasawa

(10) Patent No.: US 10,415,912 B2
(45) Date of Patent: Sep. 17, 2019

(54) BOLT STOP SHOCK-ABSORPTION DEVICE IN A GUN

(71) Applicant: TOKYO MARUI CO, LTD., Tokyo (JP)

(72) Inventor: Iwao Iwasawa, Tokyo (JP)

(73) Assignee: TOKYO MARUI CO, LTD., Tokyo (JP)

( * ) Notice: Subject to any disclaimer, the term of this patent is extended or adjusted under 35 U.S.C. 154(b) by 0 days.

(21) Appl. No.: 15/572,881

(22) PCT Filed: May 12, 2015

(86) PCT No.: PCT/JP2015/063663
§ 371 (c)(1),
(2) Date: Nov. 9, 2017

(87) PCT Pub. No.: WO2016/181507
PCT Pub. Date: Nov. 17, 2016

(65) Prior Publication Data

US 2018/0112942 A1 Apr. 26, 2018

(51) Int. Cl.

| | |
|---|---|
| ***F41A 17/36*** | (2006.01) |
| ***F41A 3/82*** | (2006.01) |
| ***F41B 11/56*** | (2013.01) |
| *F41A 33/06* | (2006.01) |

(52) U.S. Cl.
CPC ..... *F41A 17/36* (2013.01); *F41B 11/56* (2013.01); *F41A 3/82* (2013.01); *F41A 33/06* (2013.01)

(58) Field of Classification Search
CPC ..... F41A 3/82; F41A 3/86; F41A 3/88; F41A 19/01
USPC ..... 89/137, 138, 153, 179, 180, 181, 182, 89/183, 194, 198; 42/1.01, 1.02, 54
See application file for complete search history.

(56) References Cited

U.S. PATENT DOCUMENTS

| | | | | |
|---|---|---|---|---|
| 3,380,183 A * | 4/1968 | Sullivan | F41A 3/26 | 42/75.02 |
| 3,563,132 A * | 2/1971 | Cashen | F41A 9/33 | 89/132 |
| 4,244,273 A * | 1/1981 | Langendorfer, Jr. | F41A 5/28 | 89/193 |
| 4,955,812 A * | 9/1990 | Hill | F41A 33/00 | 434/16 |

(Continued)

FOREIGN PATENT DOCUMENTS

JP H10197200 7/1998

OTHER PUBLICATIONS

International Search Report dated Aug. 11, 2015.

*Primary Examiner* — Bret Hayes
(74) *Attorney, Agent, or Firm* — Jacobson Holman, PLLC

(57) ABSTRACT

A gun includes a bolt, a bolt stop member and a shock-absorption device. The bolt is movable forward or backward in a gun body, accumulates a pressure of a buffer spring while moving backward according to manipulation of the gun, and moves forward by releasing the accumulated pressure. The bolt stop member stops the bolt moving forward. The shock-absorption device includes a shock-absorption link which engages with a shock-absorption shaft which acts on the bolt stop member to absorb an impact force applied to the bolt stop member by the engagement of the bolt and the bolt stop portion.

2 Claims, 10 Drawing Sheets

(56) References Cited

U.S. PATENT DOCUMENTS

| | | | | |
|---|---|---|---|---|
| 5,457,901 | A * | 10/1995 | Gernstein | F41A 3/82 42/1.06 |
| 5,735,070 | A * | 4/1998 | Vasquez | F41A 9/62 42/1.02 |
| 6,192,780 | B1 * | 2/2001 | Schneider | F41A 3/70 89/198 |
| 2004/0144012 | A1 | 7/2004 | Adams | |
| 2008/0155875 | A1 * | 7/2008 | Iwasawa | F41B 11/644 42/54 |
| 2009/0101000 | A1 * | 4/2009 | Rawson-Harris | F41A 3/40 89/183 |
| 2010/0031812 | A1 * | 2/2010 | Kerbrat | F41A 3/38 89/190 |
| 2012/0240760 | A1 * | 9/2012 | Pizano | F41A 3/26 89/191.01 |

* cited by examiner

BOLT STOP SHOCK-ABSORPTION DEVICE IN A GUN

BACKGROUND OF THE INVENTION

The present invention relates to a bolt stop shock-absorption device including a bolt which is provided to be movable forward or backward in a gun body, accumulates a pressure of a buffer spring according to manipulation of a gun, and moves forward by releasing the accumulated pressure, and a bolt stop which stops the bolt while the bolt moves forward.

BACKGROUND ART

A bolt stop mechanism is used in a gun having a bolt which accumulates a pressure of a buffer spring according to manipulation of a gun and moves forward by releasing the accumulated pressure. For example, a simulation gun corresponds to a gas blowback type gun, and a gun which fires a live bullet (hereinafter, referred to as a real gun) corresponds to an automatic loading type gun. In this type of gun, in order to load a bullet by moving a bolt forward, the bolt collides with a bolt stop and is stopped. The collision and the stop are repeated each time the bullet is shot out.

Accordingly, whenever the bolt collides with the bolt stop, large impact is applied to the bolt stop, metal fatigue is easily generated, and in the worst case, the bolt stop may be damaged. Even when impossibility of firing is not immediately generated by the damage of the bolt stop, the damage of the bolt stop becomes a matter of concern. This problem is generated in not only the real gun but also a simulation gun which is designed to simulate the real gun. However, at the present time, a remedy for this problem cannot be ascertained.

Examining the prior art, for example, an invention disclosed in PTL 1 includes a locking member, a forward/backward movement bolt, a front abutment portion, and a movable lever member, in which the locking member selects a first position and a second position depending on whether a trigger is pulled or not, and the forward/backward movement bolt is in a state where a supply of a bullet into a bullet chamber and firing of the bullet are performed by a gas pressure when the forward/backward movement bolt moves forward along a barrel, is in a preparation state for supplying the bullet into the bullet chamber when the gas pressure is supplied and the forward/backward movement bolt moves backward along the barrel, and moves forward when the gas pressure is released. In addition, the front abutment portion provided in the forward/backward movement bolt abuts on the locking member positioned at the first position by the forward movement and maintains the forward/backward movement bolt at a standby position. Moreover, the movable lever member has a protrusion, is disposed to be movable in the forward/backward movement bolt, abuts on a locking member in which the protrusion is positioned at the first position at a position at which the movable lever member moves backward with respect to the forward/backward movement bolt, and maintains the forward/backward movement bolt at an intermediate stop position.

In a toy gun of the above-described invention, the forward movement of the bolt is prevented by the bolt abutting on a bolt stop referred to as the locking member. However, the locking member is rotatably pivoted to the gun body by a shaft. Accordingly, impact when the bolt moving forward abuts on the locking member is directly applied to the locking member and a mass of the bolt is relatively large.

Therefore, if the impact is repeatedly applied to the bolt stop, the bolt stop does not endure the impact, and thus, similarly to the bolt stop in the related art, there is a concern that the bolt stop may be damaged.

PATENT LITERATURE

Japanese Unexamined Patent Application Publication No. H10-197200

BRIEF SUMMARY OF THE INVENTION

Technical Problem

The present invention is made in consideration of the above-described problems, and an object thereof is to provide a bolt stop shock-absorption device in a gun which is not easily damaged and has high durability by absorbing impact of a bolt even when impact is repeatedly applied to a bolt stop member. In addition, another object of the present invention is to absorb impact generated by a forward movement of the bolt without manipulating a loading lever (charging handle) again by releasing an engagement between the bolt stop member and the bolt when shooting completion of a bullet is detected and a magazine is replaced to reload the bullet.

Solution to Problem

In order to achieve the above-described objects, according to an aspect of the present invention, there is provided a bolt stop shock-absorption device in a gun including: a bolt which is provided to be movable forward or backward in a gun body, accumulates a pressure of a buffer spring while moving backward according to manipulation of the gun, and moves forward by releasing the accumulated pressure force, and a bolt stop member which stops the bolt moving forward, in which the bolt stop member includes engagement means which engages with the bolt moving forward and shock-absorption means which acts on the bolt stop member to absorb an impact force applied to the bolt stop member by the engagement means.

The gun to which the bolt stop device according to the present invention is applied is assumed to be a so-called simulation gun represented by a gas gun or the like as a main target. However, a simulation gun using compressed gas and real gun using gas generated by burning gunpowder are not different from the simulation gun represented by the gag gun in that they have a bolt that blocks gas, and thus, a real gun can also be the object of the present invention. In addition, in this type of gun, there are a so-called single shoot type gun and a continuous and single shoot switching type gun. This embodiment is directed to the continuous and single shoot switching type gun, but the present invention can be also applied to the single shoot type gun.

In addition, the bolt stop member includes the engagement means which engages with the bolt moving forward and the shock-absorption means which directly or indirectly acts on the bolt stop member to absorb an impact force applied to the bolt stop member by the engagement means. This configuration has the purpose that the present invention is established as long as there is the bolt stop member and the shock-absorption means acting on the bolt stop member as a minimum constituent requirement, and it is needless to say that requirements other than these can be added to the present invention.

For example, in the present invention, preferably, the gun body includes means for detecting running out of bullets by which presence or absence of a bullet supplied to a bullet portion according to the manipulation of the gun is detected, and the means for detecting running out of bullets includes a link mechanism which causes the bolt stop member configuring the bolt stop portion to protrude into a trajectory along which the bolt moves forward or backward to be able to perform an engagement of engagement means according to the detection of the running out of bullets. That is, in the case of the continuous and single shoot switching type gun, if a gun is used for continuous shooting, the reduction of bullets is quicker, the exchange of magazines becomes more frequent, and the use frequency of bolt stop increases. Accordingly, the shock absorption according to the present invention is exerted more effectively.

In addition, preferably, the bolt stop member configuring a bolt stop member includes a long hole in a front-rear direction in which a shaft provided on the gun body side is disposed, is movable within a range of the long hole, and is rotatably provided about the shaft, and the engagement means includes an engagement portion provided in the bolt and an engagement partner portion provided in the bolt stop member and is provided to form an acute angle in a forward movement direction of the bolt. The engagement is reliably performed, and thus, an intended purposed can be sufficiently achieved.

Advantageous Effects of Invention

The present invention is configured and is operated as described above, and thus, it is possible to provide the bolt stop shock-absorption device in a gun which can absorb and attenuate impact of the bolt using the shock-absorption means and is not easily damaged and has high durability even when impact is repeatedly applied to the bolt stop member. In addition, according to the present invention, it is possible to absorb impact generated by a forward movement of the bolt without manipulating a loading lever (charging-handle) again by releasing the engagement between the bolt stop member and the bolt when shooting completion of a bullet is detected and a magazine is replaced to reload the bullet.

BRIEF DESCRIPTION OF DRAWINGS

FIG. 4 consists of FIGS. 4A and 4B and shows an operation state of the bolt stop shock-absorption device.

FIG. 5 consists of FIGS. 5A and 5B and shows the operation state of the bolt stop shock-absorption device.

FIG. 6 consists of FIGS. 6A and 6B and shows the operation state of the bolt stop shock-absorption device.

FIG. 6A is a sectional explanatory view showing a state where the bolt is manually moved backward, and FIG. 6B is a sectional explanatory view showing a state where a bullet is manually loaded.

FIG. 8 consists of FIGS. 8A and 8B and shows the operation of the gas gun.

FIG. 9 consists of FIGS. 9A and 9B and shows the operation of the gas gun.

FIG. 10 consists of FIGS. 10A and 10B and shows the operation of the gas gun.

DETAILED DESCRIPTION OF THE INVENTION

Hereinafter, the present invention will be described in detail with reference to an embodiment shown. A bolt stop shock-absorption device in a gun of the present invention is applied to all simulation guns and is not limited to a gas gun. However, for convenience, first, an outline of the gas gun will be described.

Figure 1:
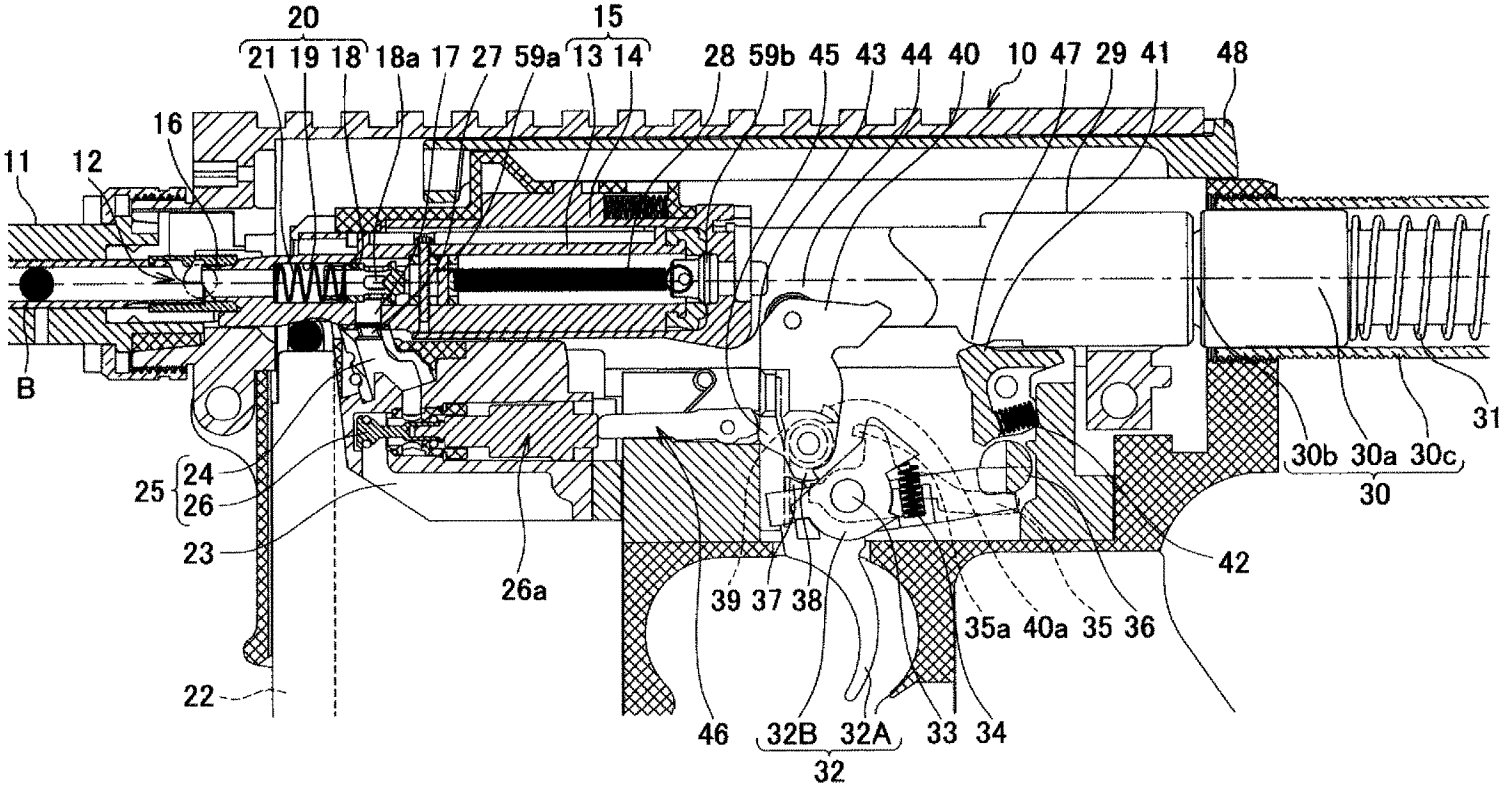
FIG. 1 is a sectional explanatory view showing an example of a gas gun to which a bolt stop shock-absorption device in a gun according to present invention is applied.

A gun exemplified as a simulation gun G in FIG. 1 is a blowback type gas gun. In the shown simulation gun G, a firing set portion 10 is provided in a center portion of a gun body, a barrel portion 11 is provided in front of the gun body 10, a magazine portion 22 is provided below the gun body, and a movable body portion 30 for a blowback bolt 29 is provided behind the gun body.

A bullet portion 12 is provided at the rear portion of the barrel portion 11, gas is ejected to a bullet B loaded on the bullet portion 12 via a differential pressure valve mechanism 20 provided in the firing set portion 10, and as a result, the bullet B is fired. A piston mechanism portion 15 is provided in the firing set portion 10, and the piston mechanism portion 15 includes a piston 13 which is movably disposed in a barrel axial direction and a cylinder 14 which functions as a movement space of the piston 13. The piston 13 is formed in a hollow cylindrical shape which includes a nozzle portion 16 ejecting the gas to the bullet B on a tip of the piston 13 and an opening, which is open to a closed end of the cylinder 14, on a rear end of the piston 13.

In the piston 13, a gas inlet 17 communicating with the inside and outside is open to a lower portion close to the front end, and the differential pressure valve mechanism 20 is provided in the vicinity of the gas inlet 17. The differential pressure valve mechanism 20 includes a differential pressure valve 18 which is disposed between the nozzle portion 16 positioned on the tip and the differential pressure valve mechanism 20, a valve chamber 19 in which the differential pressure valve 18 can move forward or backward, and a return spring 21 which is disposed in the valve chamber. An outer diameter of the differential pressure valve 18 is set so as to have a dimensional difference of a degree of sliding fit with respect to an inner diameter of the valve chamber 19.

Moreover, the differential pressure valve 18 is formed of a tubular valve in which a front end side thereof is open and a rear end side thereof is closed, and a gas passage hole 18*a* is provided on a peripheral surface of the differential pressure valve 18. Accordingly, the differential pressure valve 18 fires the bullet B which is moved backward by the return spring 21 and positioned at the bullet portion 12, moves forward by the pressure of the gas continuously flowing in the differential pressure valve 18 thereafter to close a valve, and introduces the gas flow to the cylinder 14. In this way, since an operation direction of the valve body is changed by the pressure difference, the differential pressure valve 18 is referred to as a differential pressure valve. The gas flow is introduced to the cylinder 14 and is used for a blowback operation.

The gas fills a gas tank 23 inside the magazine portion 22, and the gas is supplied from the gas tank 23 to the piston mechanism portion 15 via an on-off valve mechanism 25 according to a manipulation of a trigger described later. The on-off valve mechanism 25 includes a gas flow path 24 from the gas tank 23 to the piston mechanism portion 15 and an on-off valve 26 which is provided to open and close the gas flow path 24, and causes the gas to flow from an outlet 27 on the gas flow path end to an inlet 17. In addition, the on-off valve 26 includes a valve shaft 26*a* exposed to the outside to be press-beaten by a hammer 40 described later which is operated by the manipulation of the trigger.

In the piston mechanism portion 15, the piston 13 is urged by a return spring 28 configured of a tension spring. A front end portion of the piston return spring 28 is a piston side member 59*a* and a rear end portion thereof is attached to a cylinder side member 59*b*. The bolt 29 has a necessary mass for experiencing a simulated recoil shock, and in this embodiment, the bolt 29 is formed in a shaft shape which is elongated in a front-rear direction. In addition, the cylinder 14 is provided to be integrated with the bolt 29, and thus, a mass of the cylinder 14 is applied to the bolt 29.

The movable body portion 30 is disposed behind the bolt 29, and the movable body portion 30 includes a casing 30*c* which is attached to the gun body and a movable shaft 30*a* which is disposed inside the casing 30*c*. The movable shaft 30*a* is provided to be movable forward or backward inside the casing 30*c* is configured such that a rear end of the bolt 29 engages with a shaft head 30*b*. In the drawings, a reference numeral 31 indicates a buffer spring, the buffer spring 31 urges the movable shaft 30*a* in a forward movement direction, and thus, finally, the buffer spring 31 is operated to position the piston mechanism portion 15 in a firing preparation state. In addition, the buffer spring 31 receives the bolt 29 when the bolt 29 moves backward and also functions as means for adjusting the impact at the end of the recoil shock.

In order to operate the firing set portion 10, a trigger 32 is provided. The trigger 32 is configured by combining two members 32A and 32B, the trigger member 32A is a manipulating portion, and the trigger member 32B is a manipulated member. The two members 32A and 32B are rotatable about a shaft 33 and are urged in a direction away from each other by a trigger spring 34. A reference numeral 35 indicates a disconnector, and the disconnector 35 is coaxially provided with the trigger member 32A to select a continuous shoot or a single shoot and is controlled by a selector 36.

The trigger member 32A locks the above-described hammer 40 in a cocking state. A reference numeral 37 indicates a trigger side locking portion which maintains the cocking state and a reference numeral 38 is a hammer side locking portion which maintains the locking state. A reference numeral 39 indicates a hammer spring and becomes in an accumulated pressure state at the time of cocking. Accordingly, if the trigger 32A is manipulated, an engagement between the locking portions 37 and 38 is released, and thus, the accumulated pressure of the hammer spring 39 is also released, and the hammer 40 is operated.

The hammer 40 is placed in an engagement state between a shear 41 and the hammer 40 at the time of the cocking. A spring 42 acts on the shear 41, and the shear 41 acts in a direction in which the cocking of the hammer 40 is maintained. The hammer 40 is cocked by a backward movement of the cylinder 14. Accordingly, a cam-shaped engagement protrusion 43 is provided on a lower portion of a rear end of the cylinder 14, and the engagement protrusion 44 is pivoted by the hammer 40. A reference numeral 45 indicates a press-beating portion of the hammer 40 and the press-beating portion 45 drives a valve shaft 26*a* via a knocker 46. A reference numeral 47 indicates a bolt protrusion and the bolt protrusion 47 rotates the shear 41 against the shear spring 42 and causes the hammer 40 which is in the cocking state to be rotatable. A reference numeral 48 is a loading lever (charging handle), the cylinder 14 is moved backward by manipulation of the loading lever 48 which engages with the front side of the cylinder 14, and thus, the hammer 40 can be cocked. The protrusions 44 and 47 may be simple protrusions or may be rolls.

Figure 2:
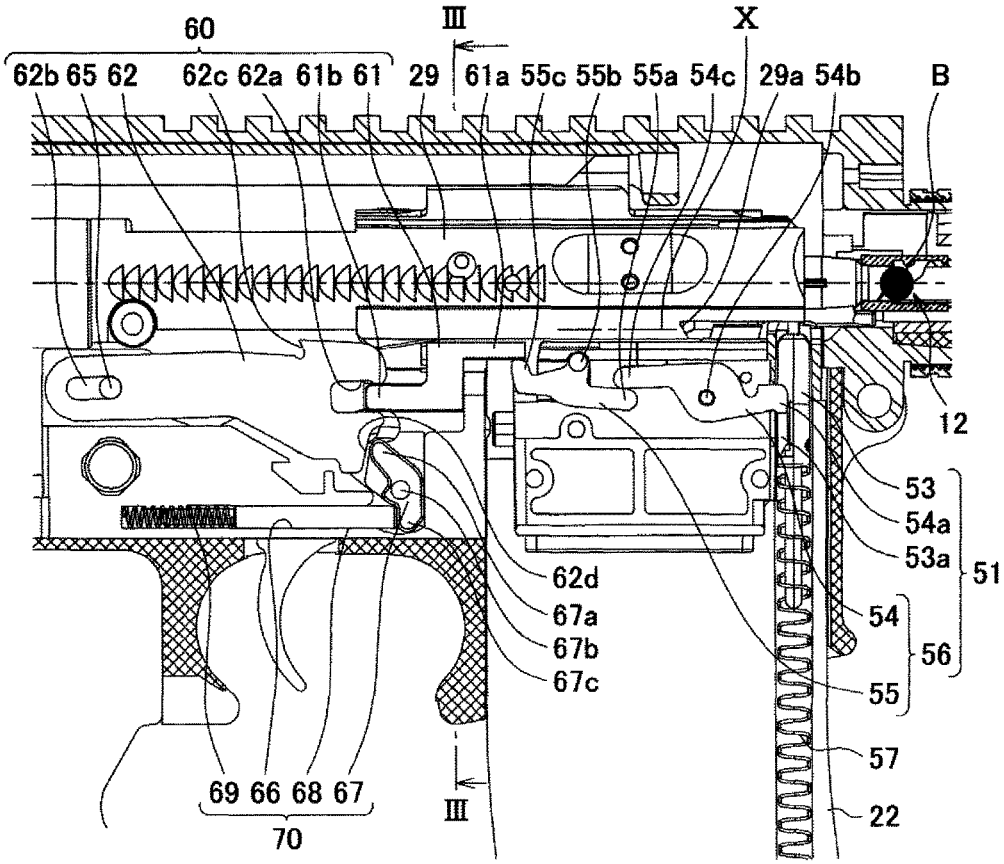
FIG. 2 is a sectional explanatory view showing a main portion of the bolt stop shock-absorption device in an enlarged manner.

The embodiment of the bolt stop shock-absorption device in the gun according to the present invention is shown in detail in FIG. 2. In the gas gun of this embodiment, a main portion of the shock-absorption device is positioned on the right side of the gun body, and thus, for convenience, in FIGS. 2 and 4 to 6, the gun body is also shown at the right, contrary to FIG. 1 or the like.

The bolt stop shock-absorption device of the embodiment includes the bolt 29 which accumulates a pressure according to manipulation of the gun and moves forward by releasing of the buffer spring 31 and a bolt stop member 62 which stops the bolt 29 moving forward. Particularly, the present embodiment includes a configuration which protrudes the bolt stop member 62 in a trajectory X along which the bolt 29 moves forward or backward by an operation of means 51 for detecting running out of bullets, and impact generated when the bolt 29 moving forward and the bolt stop member 62 collide with each other is absorbed by shock-absorption means 70.

In order to detect that the final bullet B loaded in the magazine portion 22 is fired, a follower 53 is provided. If a follower spring 57 which is provided in the magazine portion 22 and compressed by the bullet is extended by a repulsive force, the follower 53 is lifted according to the extension of the follower spring 57. The follower 53 includes a follower lever 53*a*, and the lever 53*a* engages with one end portion 54*a* of a follower link 54 to configure a front end portion of the means 51 for detecting running out of bullets. The means 51 for detecting running out of bullets shown in the embodiment further includes the follower link 54 which is oscillatingly pivoted by a shaft portion 54*b* and an intermediate link 55.

The other end portion 54*c* of the follower link 54 engages with one end portion 55*a* of the intermediate link 55, and the follower link 54 and the intermediate link 55 are oscillatingly pivoted by shaft portions 54*b* and 55*b*, respectively.

The other end portion 55*c* of the intermediate link 55 engages with one end portion 61*a* of a relay member 61 between the bolt stop portion 60 and the intermediate link 55 and causes the bolt stop portion 60 to protrude into the trajectory X along which the bolt 29 moves forward or backward. The follower link 54 and the intermediate link 55 configures a link mechanism 56 which causes the means 51 for detecting running out of bullets and the bolt stop portion 60 to communicate with each other.

The relay member 61, the bolt stop member 62, or the like configure the bolt stop portion 60. One end portion 61*a* of the relay member 61 engages with the other end portion 55*c* of the intermediate link 55, and the other end portion 61*b* of the relay member 61 engages with a groove portion 62*a* of the bolt stop member 62. Accordingly, if the means 51 for detecting running out of bullets detects running out of bullets, information of running out of bullets that the bullets B disposed in the bullet portion 12 have been shot out is sequentially transmitted to the bolt stop portion 60 by the link mechanism 56.

Figure 3:
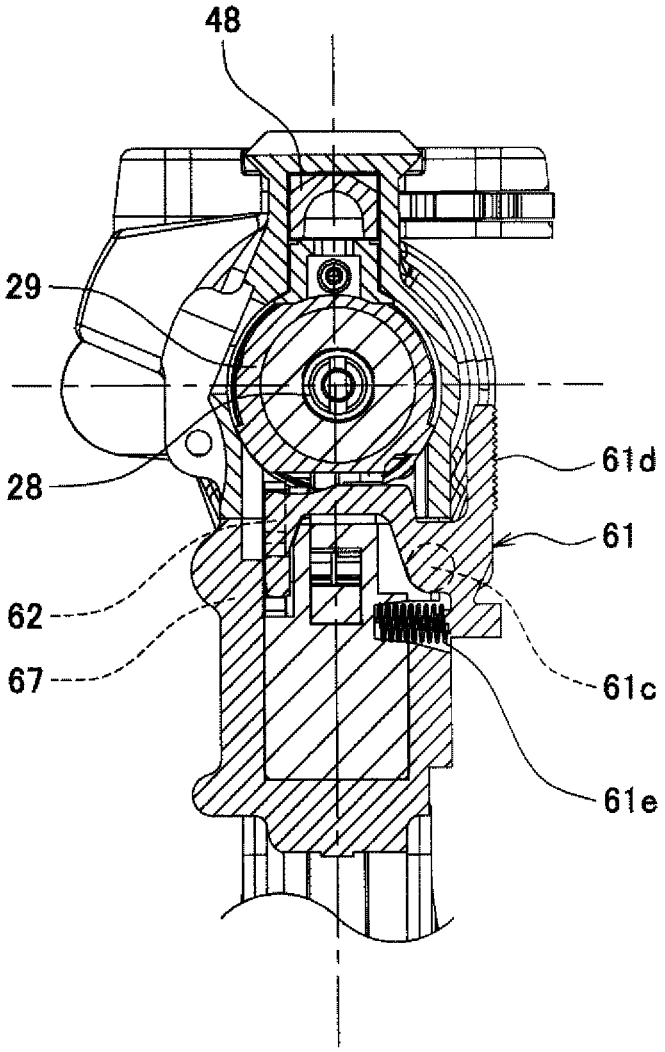
FIG. 3 is a cross-sectional view taken along line III-III of FIG. 2.

Referring to FIG. 3, the relay member 61 is shown as a member extending to the right and left of the gun body and is pivoted to the gun body side by a left shaft 61*c*. The relay member 61 is provided such that a portion on a right portion (shown as a crank shape in FIG. 2) is able to move up and down by a rotation of the relay member 61 around an axis. In addition, the relay member 61 includes a manipulating portion 61*d* which is positioned above the shaft 61*c* and is shown on the left side of the gun body. A spring 61*e* acts on the upper portion of the manipulating portion 61*d*, and thus, the manipulating portion 61*d* is provided to return the relay member 61 to a home position and to press the bolt stop member 62 described later.

A long hole 62*b* in a front-rear direction is formed in the bolt stop member 62, and the bolt stop member 62 is oscillatingly pivoted to the gun body side by a shaft 65. Accordingly, the bolt stop member 62 is movable by a stroke amount in a long hole 62*b* and is rotatable about the shaft 65. As a result of this configuration, the side of an engagement partner 62*c* of the bolt stop member 62 is lifted via the relay member 61 by the link mechanism 56, and the bolt 29 can protrude into the trajectory X in which the bolt 29 moves forward or backward.

An engagement portion 29*a* which engages with one side of the engagement means 59 is provided in the bolt 29, and the engagement portion 29*a* is provided to be able to engage with the engagement partner 62*c* which is provided in the bolt stop member 62 as the other side of the engagement means 59. Particularly, in the embodiment, the engagement portion 29*a* and the engagement partner 62*c* are provided as inclination portions which form an acute angle in the forward movement direction of the bolt 29. Since the bolt stop member 62 is pivoted by the shaft 65 in the long hole 62*b* in the front-rear direction, the inclinations of the engagement portion 29*a* and the engagement partner 62*c* eliminate instability of the engagement generated in a case where the engagement portion 29*a* and the engagement partner 62*c* are formed at right angles, and thus, improve reliability of the engagement.

The shock-absorption means 70 acts on the bolt stop portion 60. In the embodiment, the shock-absorption means 70 includes a shock-absorption link 67, and a shock-absorption shaft 68 and a shock-absorption spring 69 which are movably incorporated into an attachment portion 66 on the gun body side in the front-rear direction. The shock-absorption link 67 is oscillatingly pivoted to the gun body side by the shaft 67*b*, one end of the shock-absorption link 67 engages with a front engagement portion 62*d* of the bolt stop member 62 and the other end thereof engages with the tip of the shock-absorption shaft 68. Accordingly, when the bolt 29 collides with the bolt stop member 62 according to the forward movement of the bolt 29, impact generated when the bolt stop member 62 moves in a direction of a muzzle is transmitted to the shock-absorption means 70.

Since the relay member 61 and the bolt stop member 62 are lined up in a direction of a gun base from the muzzle, the bolt 29 collides with the bolt stop member 62 in the bolt stop portion 60 when the bolt 29 moves forward. However, the relay member 61 has a shape which does not come into contact with the bolt 29 and has a shape which does not come into contact with the bolt 29 even when the bolt stop member 62 moves at maximum, and thus, the bolt 29 does not come into direct contact with the relay member 61. The bolt stop member 62 engages with the shaft 65 in the long hole 62*b*, and thus, the bolt stop member 62 can move with a length of the long hole 62*b* as a maximum limit. When the bolt stop member 62 move at maximum, the other end portion 61*b* of the relay member 61 further enters the groove portion 62*a* of the bolt stop member 62.

Figure 4A:
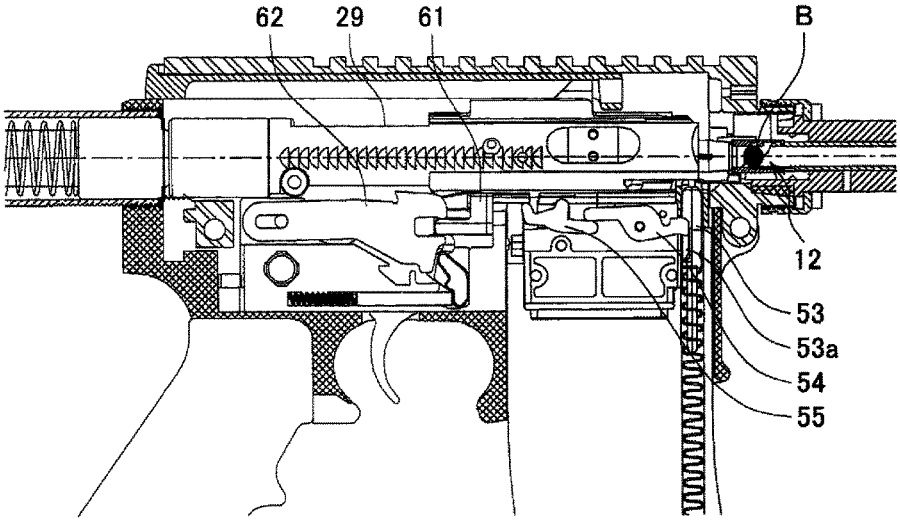
FIG. 4A is a sectional explanatory view showing a state before a final bullet is fired.
Figure 4B:
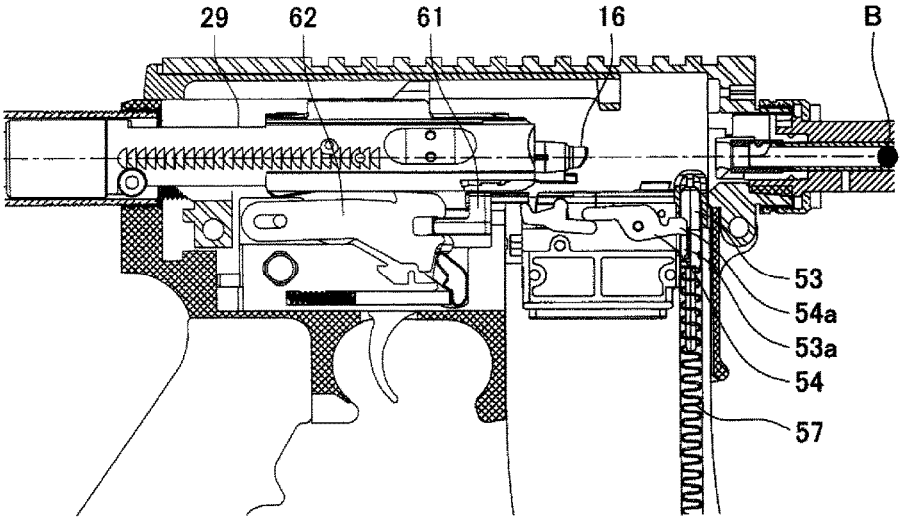
FIG. 4B is a sectional explanatory view showing a state after the final bullet is fired.

In the bolt stop shock-absorption device of the gun of the present invention configured as described above, if the bullet B is fired and the bullet B does not exist in the magazine portion 22 in a state where the final bullet B is positioned in the bullet portion 12 (FIG. 4A), the bolt 29 starts to move backward, the follower 53 is lifted to the highest position around the rear side of the bullet portion 12 by the repulsive force of the follower spring 57, and the one end portion 54*a* of the follower link 54 engaging with the follower lever 53*a* is pushed up (FIG. 4B). The operation accompanying this pushing up is transmitted from the follower link 54 to the bolt stop member 62 via the intermediate link 55 and the relay member 61.

Figure 5A:
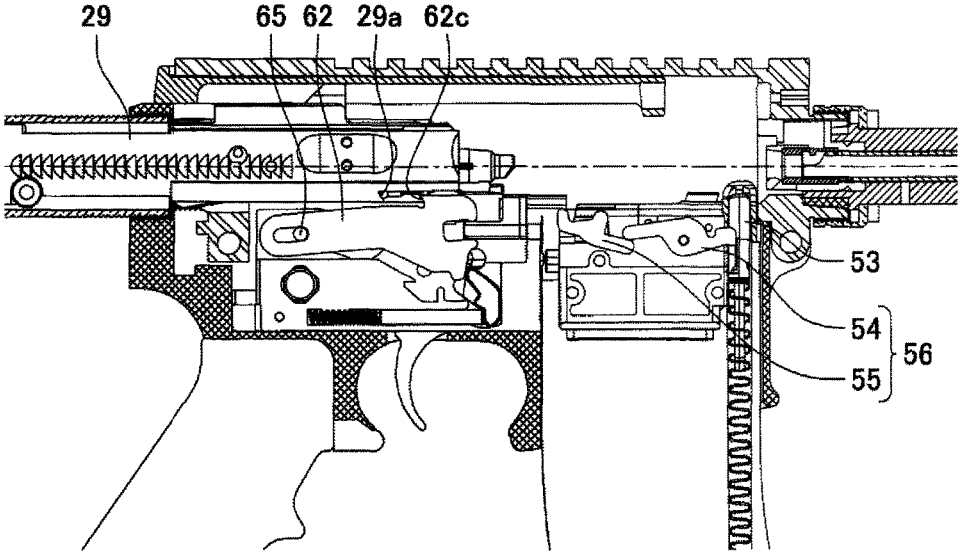
FIG. 5A is a sectional explanatory view showing a state where a bolt moves backward farthest.
Figure 5B:
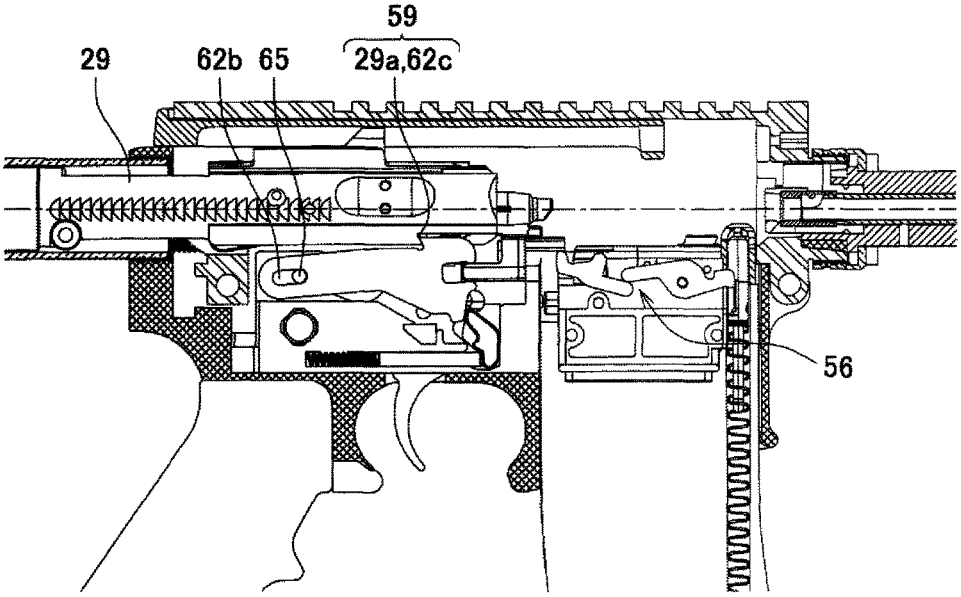
FIG. 5B is a sectional explanatory view showing a state where the blot starts to move forward.

If the bolt 29 moves backward farthest (FIG. 5A), the follower 53 is lifted to the highest position to complete the lifting, and the operation of the bolt stop member 62 is completed by the transmission operation of the link mechanism 56. As a result, the bolt stop member 62 rotates about the shaft 65, the tip side of the bolt stop member 62 is pushed up by the relay member 61, and the engagement partner 62*c* configuring the inclination portion protrudes into the trajectory X along which the bolt 29 moves forward or backward. The bolt 29 receive the repulsive force of the buffer spring 31 which accumulates a pressure according to the backward movement of the bolt 29 and moves forward, and thus, the engagement portion 29*a* and the engagement partner 62*c* engage with each other at the inclination portions (FIG. 5B).

Figure 6A:
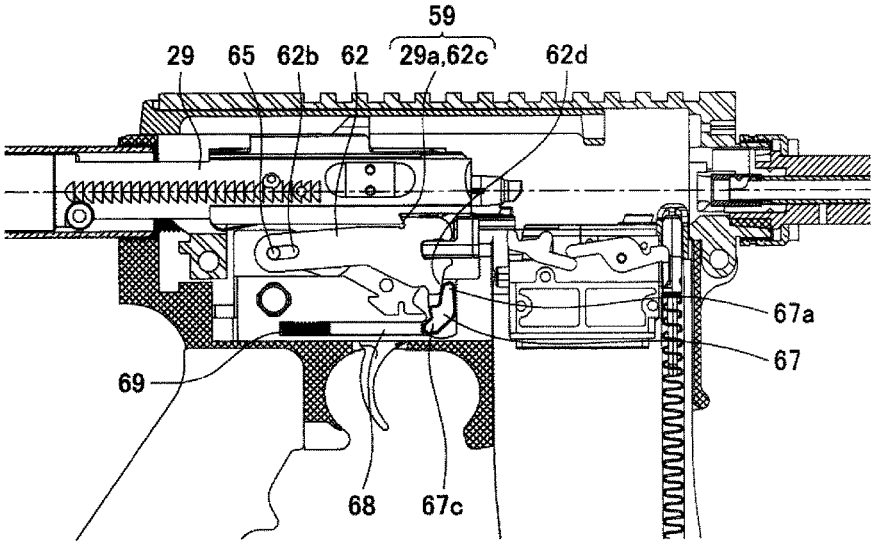
FIG. 6A is a sectional explanatory view showing a position at which a bolt stop member moves forward farthest.
Figure 6B:
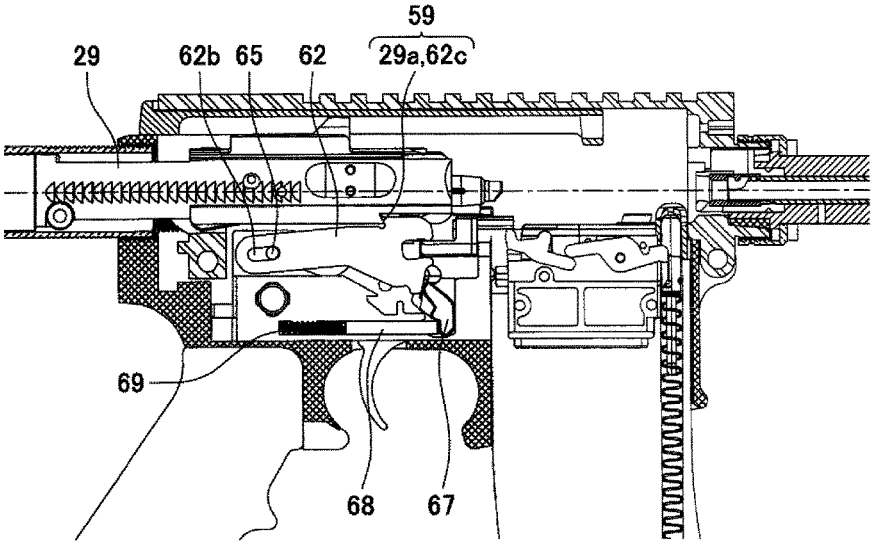
FIG. 6B is a sectional explanatory view showing a state where the bolt stop member is moved backward by the shock-absorption spring within a range of a long hole.

If the bolt 29 further moves forward, the bolt stop member 62 is entrained forward by the engagement means 59 and the shaft 65 moves toward the rear end of the long hole 62*b* from the front end of the disposed long hole 62*b* (FIG. 6A). While the bolt stop member 62 moves as described above, the shock-absorption link 67 with which the front engagement portion 62*d* engages is pressed by one end portion 67*a*, and the shock-absorption shaft 68 engaging with the other end 67*c* is pressed. Accordingly, when the bolt 29 collides with the bolt stop member 62 according to the forward movement of the bolt 29, impact generated when the bolt stop member 62 moves in the direction of the muzzle is absorbed by the shock-absorption means 70, and thus, the bolt 29 gently stops. Next, the bolt stop member 62 is pushed backward by the elastic force of the shock-absorption spring 69, and the bolt 29 moves backward to the position shown FIG. 5B, and the operation of the shock-absorption device is completed.

Figure 7A:
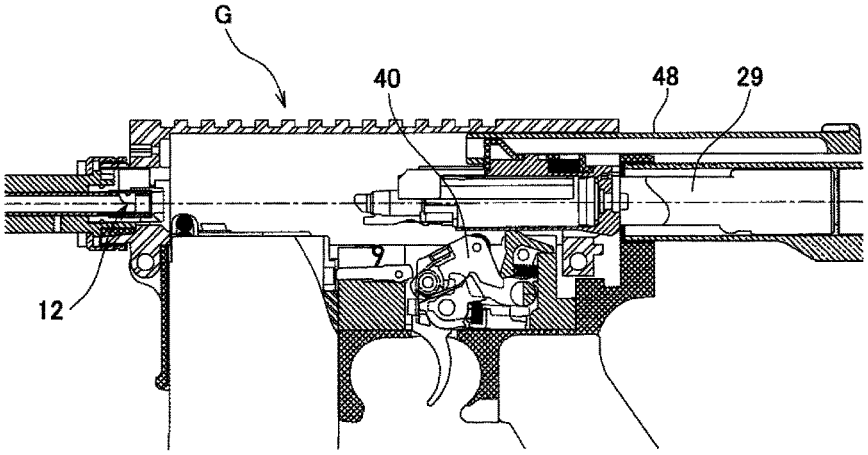
FIG. 7 consists of FIGS. 7A and 7B and shows an operation of the gas gun.
Figure 7B:
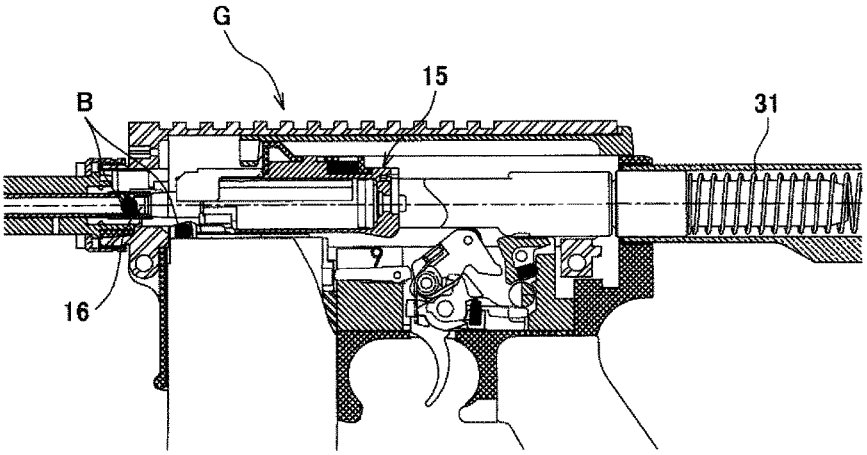

An overall operation of the simulation gun G in the present invention will be described as follows. The bolt 29 is moved backward by manually manipulating the loading lever 48, and the hammer 40 become in a cocking state (state of FIG. 7A). If the loading lever 48 is released, the bolt 29 is moved forward by the buffer spring 31, one bullet B is loaded into bullet portion 12 by nozzle portion 16 of the piston mechanism portion 15 which integrally moves with the bolt 29 (FIG. 7B).

Figure 8A:
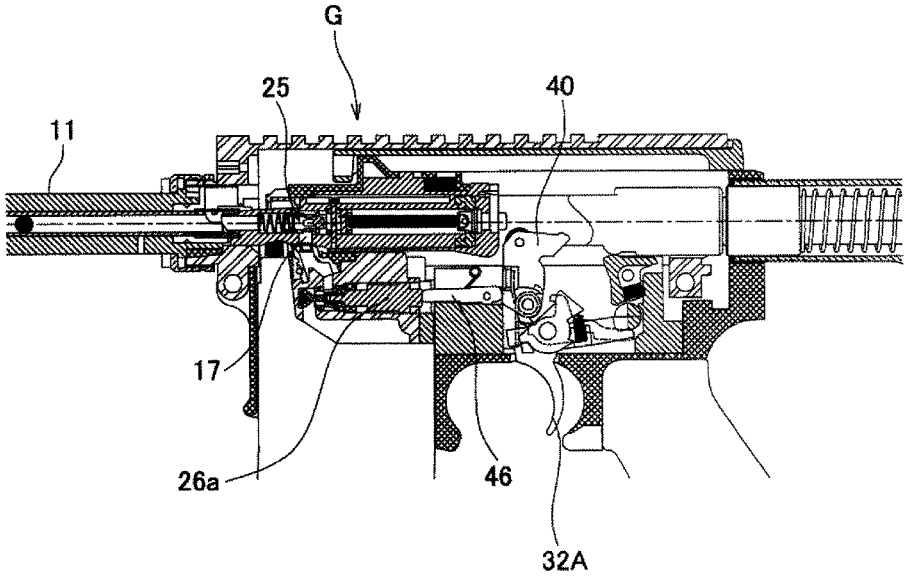
FIG. 8A is a sectional explanatory view showing a state where the bullet is fired.
Figure 8B:
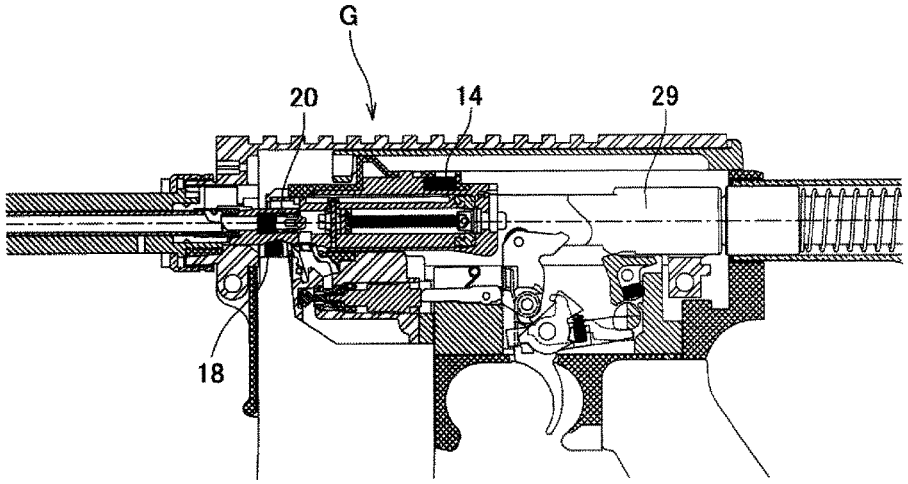
FIG. 8B is a sectional explanatory view showing a state where the bolt starts to move backward.

Subsequently, if trigger 32A is pulled and hammer 40 is operated, the valve shaft 26*a* is pushed via knocker 46, the on-off valve mechanism 25 is open, and compressed gas flows into gas inlet 17. The compressed gas flows into the differential pressure valve 18 from the gas communication port 18*a* of the differential pressure valve mechanism 20 and is ejected to bullet B, and as a result, the bullet B is fired from the barrel 11 (FIG. 8A). The differential pressure valve 18 is moved forward by the pressure of the gas which continuously flows in even after the bullet is fired, the differential pressure valve mechanism 20 is closed, and the gas flow is introduced to the cylinder 14 (FIG. 8B).

Figure 9A:
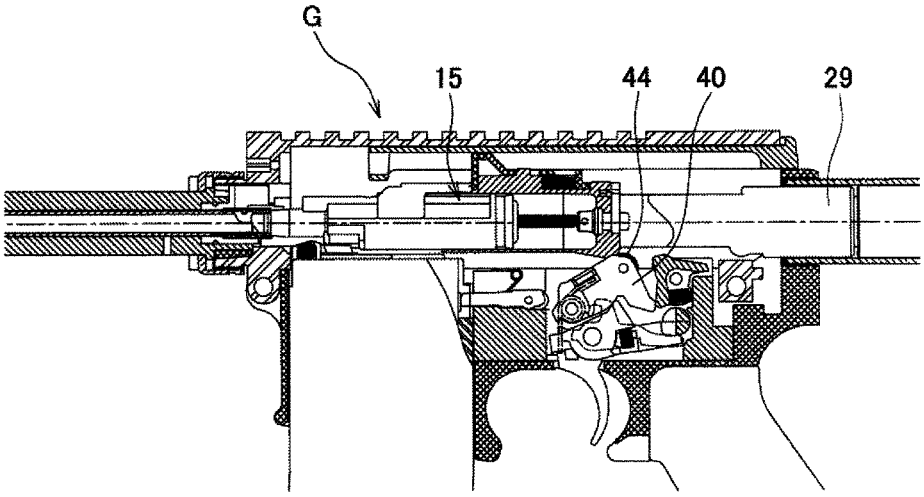
FIG. 9A is a sectional explanatory view showing a state where a hammer is cocked by the bolt.
Figure 9B:
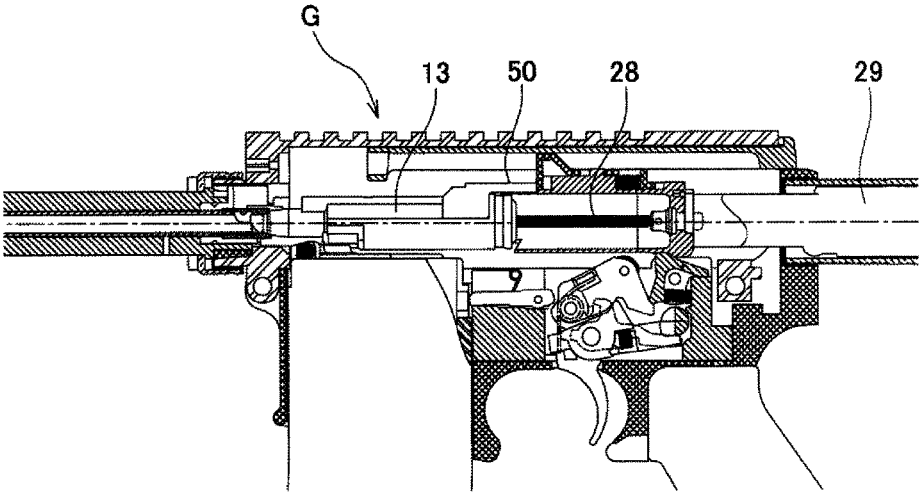
FIG. 9B is a sectional explanatory view showing a state where the piston starts to move backward.

As the gas flows into the cylinder 14, the piston mechanism portion 15 is moved backward along with the bolt 29, and in the process, the hammer 40 is cocked (FIG. 9A). If the bolt 29 is moved backward to a certain extent, the piston 13 starts to move backward along with the piston stop 50 and is drawn in a bolt direction by the piston return spring 28 (FIG. 9B).

Figure 10A:
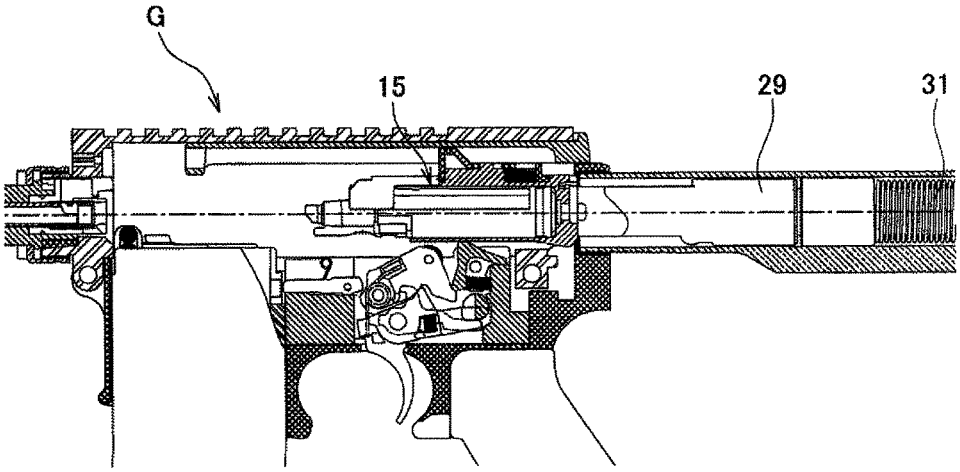
FIG. 10A is a sectional explanatory view showing a state where the bolt is positioned at a position moved backward farthest.
Figure 10B:
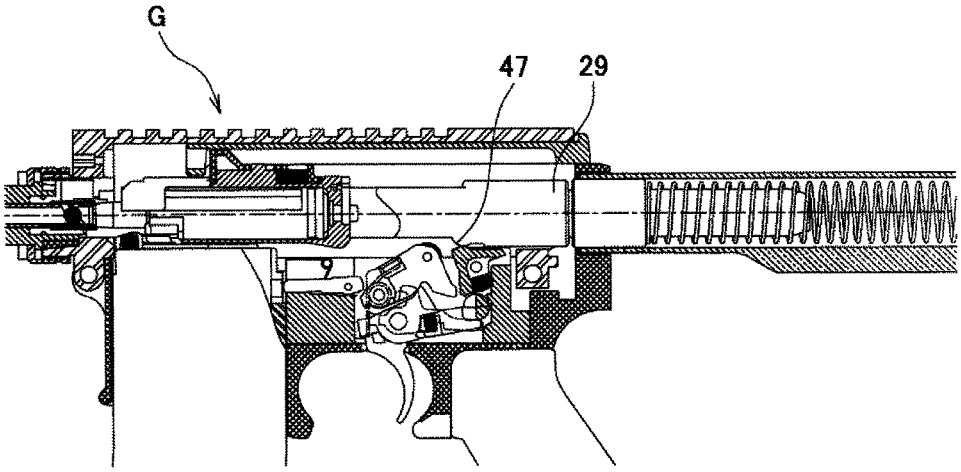
FIG. 10B is a sectional explanatory view showing a state where the bolt moves forward and the bullet is supplied to a bullet portion.

The bolt 29 stops after moving backward to a position moved backward farthest along with the piston mechanism portion 15 (FIG. 10A), and a manipulator of the simulation gun G experiences a shock accompanying the movement of the mass of the bolt 29 during this time. The buffer spring 31 in which the pressure is accumulated by the backward movement is released, the bolt 29 is switched to move forward, and one bullet B is loaded in the bullet portion 12 by the nozzle portion 16 positioned at the tip of the piston mechanism which integrally moves with the bolt 29 (FIG. 10B). In addition, the protrusion 47 of the bolt 29 rotates the shear 41, and thus, the hammer 40 is released, the state is returned to the state of FIG. 7B, and the fire operation is repeated (fire mode). In a case of a single shoot mode, the hammer 40 engages with the disconnector 35 and the engagement portion 35*a* and 40*a* and is stopped. Since the locking is released by returning the trigger 32, the hammer 40 is locked to the trigger 32 and is held in the cocking state.

In the bolt stop shock-absorption device in the gun of the present invention, the bolt stop member 62 stopping the bolt 29 is indirectly absorbed by the shock-absorption means 70, damage of the bolt stop member 62 is prevented, and it is possible to prevent the gun from being not operated suddenly. In addition, in the device of the present invention, when the running out of the bullets B indicating the bullets B running out is detected and a magazine is replaced to reload the bullets, it is not necessary to manipulate the loading lever (charging handle) again by releasing the bolt stop member 62.

REFERENCE NUMBERS

10: firing set portion
11: barrel portion
12: bullet portion
13: piston
14: cylinder
15: piston mechanism portion
16: nozzle portion
17: gas inlet
18: differential pressure valve
19: valve chamber
20: differential pressure valve mechanism
21: return spring
22: magazine portion
23: gas tank
24: gas flow path
25: on-off valve mechanism
26: on-off valve
27: outlet
28: piston return spring
29: bolt
30: movable body portion
31: buffer spring
32, 32A, 32B: trigger
33: shaft
34: trigger spring
35: disconnector
36: selector
37, 38: locking portion
39: hammer spring
40: hammer
41: shear
42: shear spring
43: engagement protrusion
44: engagement ring
45: press-beating portion
46: knocker
47: bolt protrusion
48: loading lever
51: means for detecting running out of bullets
53: follower
54: follower link
55: intermediate link
56: link mechanism
57: follower spring
59: engagement means
60: bolt stop portion
61: relay member
62: bolt stop member
65: shaft
66: attachment portion
67: shock-absorption link
68: shock-absorption shaft
69: shock-absorption spring
70: shock-absorption means

The invention claimed is:

1. A gun comprising a bolt, a bolt stop portion, a shock-absorption link, a shock-absorption shaft and a shock-absorption spring, wherein the bolt is adapted to move backward in pressing a buffer spring behind the bolt and move forward in releasing the pressed buffer spring, wherein the bolt stop portion engages with the bolt in a trajectory along which the bolt moves forward or backward, and the bolt stop portion causes the bolt to stop moving, wherein the shock-absorption link is rotatably connected to a body of the gun, a first end of the shock-absorption link engages with the bolt stop portion, and a second end of the shock-absorption link engages with the shock-absorption shaft, the shock-absorption shaft engages with the shock-absorption spring, wherein the shock-absorption shaft and the shock-absorption spring are parallel to the buffer spring, and wherein the shock-absorption link, the shock-absorption shaft and the shock-absorption spring absorb energy that is generated when the bolt engages the bolt stop portion.

2. A gun comprising a bolt, a bolt stop portion, a shock-absorption link, a shock-absorption shaft and a shock-absorption spring, wherein the bolt is adapted to move backward in pressing a buffer spring behind the bolt and move forward in releasing the pressed buffer spring, wherein the bolt stop portion engages with the bolt in a trajectory along which the bolt moves forward or backward, and the bolt stop portion causes the bolt to stop moving, wherein the shock-absorption link is rotatably connected to a body of the gun, a first end of the shock-absorption link engages with the bolt stop portion, and a second end of the shock-absorption link engages with the shock-absorption shaft, the shock-absorption shaft engages with the shock-absorption spring, wherein the shock-absorption link, the shock-absorption shaft and the shock-absorption spring absorb energy that is generated when the bolt engages the bolt stop portion;

wherein the gun further comprises a means for detecting running out of bullets, wherein the bolt stop portion has an engagement partner, wherein, following detecting that bullets are run out by the means for detecting running out of bullets, the engagement partner protrudes into the trajectory of the moving forward or backward of the bolt, and wherein the engagement partner engages with the bolt in the trajectory of the moving forward or backward of the bolt, which causes the bolt to stop moving forward.

* * * * *